US005593317A

United States Patent [19]

Humbles

[11] Patent Number: 5,593,317

[45] Date of Patent: Jan. 14, 1997

[54] MODULAR FURNITURE COMMUNICATION SYSTEM

[75] Inventor: Marvin L. Humbles, Collinsville, Ill.

[73] Assignee: The Whitaker Corporation, Wilmington, Del.

[21] Appl. No.: 298,197

[22] Filed: Aug. 31, 1994

[51] Int. Cl.[6] ..... H01R 11/00

[52] U.S. Cl. ..... 439/502

[58] Field of Search ..... 439/502, 505, 439/623, 624, 215, 894, 894.1, 941; 29/857

[56] References Cited

U.S. PATENT DOCUMENTS

| | | | |
|---|---|---|---|
| 3,677,101 | 6/1972 | Kloth | 439/623 |
| 3,761,842 | 9/1973 | Gandrud | 439/894.1 |
| 3,856,981 | 12/1974 | Boundy | 174/48 |
| 4,203,639 | 5/1980 | VandenHoek et al. | 439/215 |
| 4,214,799 | 7/1980 | Biche | 439/215 |
| 4,231,630 | 11/1980 | Propst et al. | 439/215 |
| 4,239,932 | 12/1980 | Textoris et al. | 174/48 |
| 4,377,724 | 3/1983 | Wilson | 174/48 |
| 4,631,881 | 12/1986 | Charman | 52/220.7 |
| 4,792,881 | 12/1988 | Wilson et al. | 361/827 |
| 4,815,984 | 3/1989 | Sugiyama et al. | 439/502 |
| 4,928,303 | 5/1990 | Allin et al. | 379/93 |
| 4,941,845 | 7/1990 | Eppley et al. | 439/505 |
| 5,149,277 | 9/1992 | LeMaster | 439/502 |
| 5,226,835 | 7/1993 | Baker, III et al. | 439/894.1 |
| 5,272,277 | 12/1993 | Humbles et al. | 174/48 |
| 5,299,956 | 4/1994 | Brownell et al. | 439/894.1 |
| 5,340,331 | 8/1994 | Bohlen et al. | 439/502 |
| 5,362,257 | 11/1994 | Neal et al. | 439/894 |

*Primary Examiner*—Neil Abrams
*Assistant Examiner*—Barry Matthew L. Standig

[57] ABSTRACT

A telecommunications wiring device comprising first and second connectors, a first cable segment and a diversion lead. Preselected wires from the first cable segment are terminated in the first connector, while all wires from the other end of the first cable segment are terminated in the second connector. Wires in the diversion lead are preselectively terminated in the first connector in unoccupied termination locations. As a result, certain electronic signals entering the first connector will continue through the first cable segment while other signals entering the first connector will be diverted through the diversion lead. This construction allows electronic signals to be diverted to a user telecommunications device without creating bridge tap on the signal path.

20 Claims, 6 Drawing Sheets

| | | | | | | | | | | |
|---|---|---|---|---|---|---|---|---|---|---|
| PR 12 | BLACK/ORANGE | 25 | T4 | | | T4 | 50 | VIOLET/BROWN | PR24 |
| | ORANGE/BLACK | 24 | R4 | | | R4 | 49 | BROWN/VIOLET | |
| PR 11 | BLACK/BLUE | 23 | T3 | | | T3 | 48 | VIOLET/GREEN | PR 23 |
| | BLUE/BLACK | 22 | R3 | | | R3 | 47 | GREEN/VIOLET | |
| PR 10 | RED/GRAY | 21 | T2 | C | F | T2 | 46 | VIOLET/ORANGE | PR 22 |
| | GRAY/RED | 20 | R2 | | | R2 | 45 | ORANGE/VIOLET | |
| PR 9 | RED/BROWN | 19 | T1 | | | T1 | 44 | VIOLET/BLUE | PR 21 |
| | BROWN/RED | 18 | R1 | | | R1 | 43 | BLUE/VIOLET | |
| PR 8 | RED/GREEN | 17 | T4 | | | T4 | 42 | YELLOW/GRAY | PR 20 |
| | GREEN/RED | 16 | R4 | B | E | R4 | 41 | GRAY/YELLOW | |
| PR 7 | RED/ORANGE | 15 | T3 | | | T3 | 40 | YELLOW/BROWN | PR 19 |
| | ORANGE/RED | 14 | R3 | | | R3 | 39 | BROWN/YELLOW | |
| SKIP | GRAY/VIOLET | 13 | | | | | 38 | VIOLET/GRAY | SKIP |
| PR 6 | RED/BLUE | 12 | T2 | | | T2 | 37 | YELLOW/GREEN | PR 18 |
| | BLUE/RED | 11 | R2 | B | E | R2 | 36 | GREEN/YELLOW | |
| PR 5 | WHITE/GRAY | 10 | T1 | | | T1 | 35 | YELLOW/ORANGE | PR 17 |
| | GRAY/WHITE | 9 | R1 | | | R1 | 34 | ORANGE/YELLOW | |
| PR 4 | WHITE/BROWN | 8 | T4 | | | T4 | 33 | YELLOW/BLUE | PR 16 |
| | BROWN/WHITE | 7 | R4 | | | R4 | 32 | BLUE/YELLOW | |
| PR 3 | WHITE/GREEN | 6 | T3 | | | T3 | 31 | BLACK/GRAY | PR 15 |
| | GREEN/WHITE | 5 | R3 | A | D | R3 | 30 | GRAY/BLACK | |
| PR 2 | WHITE/ORANGE | 4 | T2 | | | T2 | 29 | BLACK/BROWN | PR 14 |
| | ORANGE/WHITE | 3 | R2 | | | R2 | 28 | BROWN/BLACK | |
| PR 1 | WHITE/BLUE | 2 | T1 | | | T1 | 27 | BLACK/GREEN | PR 13 |
| | BLUE/WHITE | 1 | R1 | | | R1 | 26 | GREEN/BLACK | |

Fig. 6

MODULAR FURNITURE COMMUNICATION SYSTEM

BACKGROUND OF THE INVENTION

1. Field of the Invention

This invention relates to telecommunications and, more particularly, to a telecommunications wiring device and system for providing reliable analog and digital transmission of electrical signals, using componentry capable of operating at Level 5 (100 Megabits per second) where desired.

2. Related Art

Existing office telecommunications wiring systems are directed either to (1) a conventional hard-wired system which requires a technically skilled person for configuration or reconfiguration of an office telecommunications network or (2) a system such as that described in U.S. Pat. No. 5,272,277 ("the '277 patent") issued to Humbles et at., which is hereby incorporated by reference in its entirety, which allows a technically unskilled person to configure or reconfigure an office telecommunications network through the use of modular reusable devices.

The conventional method of telecommunications wiring is extremely costly because it requires a substantial amount of time and labor for a skilled technician to physically place a line from a local telephone company distribution/demarcation block to each individual user telecommunications device (such as a telephone, telefax or computer). The system described in the '277 patent represents an extreme improvement over the conventional method in that it uses a modular, reusable format to install the transmission media instead of hardwiring each device. Use of the '277 system eliminates the need for a highly skilled technician and enables an untrained technician to reconfigure an office telecommunications network quickly and easily. It should be noted that this system can be used for both telephonic analog and computer digital communication.

Because many conventional computers transmit and receive data at a rate of 10 Mbps or 16 Mbps, digital transmission of computer signals may be accommodated by the traditional method or the '277 system. However, the wiring system of the '277 patent is superior because of increased speed of reconfiguration, reduced expense of administrative record keeping, and lowered costs associated with employing an unskilled technician.

More recently, various "information highways" have been established on local area networks and wide area networks. Computing power has increased tremendously because of successive generations of Very Large Scale Integration ("VLSI") chips while its costs have dropped dramatically. These factors have helped increase demand for the same, thereby increasing the volume of information transmitted. The increase in volume of information transmitted coupled with technological improvements have created a need for an increased rate of digital transmission.

In particular, a transmission rate known in the art as "Level 5," or 100 Mbps, is increasingly required. The challenge is to provide physical facilities which can achieve this transmission rate reliably. The greatest barriers to achieving this transmission rate are presented by Attenuation, NEXT (Near End Crosstalk), Noise and Capacitance.

Attenuation is the signal loss on twisted-pair cable. Poor quality RJ45 block connections can lead to excessive resistance and attenuation. This may be corrected by making sure that each of the conductors are seated completely within the connection and that the correct type of connector/wire combination (stranded or solid) is used. Excessive length may also cause signal loss which may be corrected by adding a repeater or eliminating excessive cable coiled in ceilings or wiring closets. It is also prudent to verify that the length of the conductors fall within manufacturer's guidelines for the network. Where patch cables are necessary, use high grade cables with a minimum length possible as use of non-twisted pair patch cables, i.e., Silkline, can adversely effect results.

NEXT, or Near End Crosstalk, is a measure of the amount of signal which "leaks" from the station's (or hub's) transmitter to its own receiver. Most of this leakage occurs between the transmit pair and the receive pair and is symmetric (e.g., 12–36 NEXT is always the same as 36–12 NEXT). To measure NEXT, signals of known amplitude and frequency are transmitted on each pair within the cable in succession. The amount of signal coupled to adjacent pairs is measured and reported as NEXT. The frequency range used to measure NEXT varies among different network topologies. The following table lists frequency test ranges for common network types:

| Network Topology | NEXT Frequency Range |
|---|---|
| 4 Mbps Token Ring | 1.0 ~ > 4.0 Mhz |
| 16 Mbps Token Ring | 4.0 ~ > 16.0 Mhz |
| 10 Base T | 5.0 ~ > 10.0 Mhz |
| Custom Twisted-Pair | 1.0 ~ > 20.0 Mhz |

The test signals are transmitted by sweeping the frequency range and NEXT is measured for each of the pairs. The worst case NEXT and the frequency at which it occurred is used to determine whether the pair meets or exceeds test limits. Possible causes of an unacceptable NEXT reading can be traced to excess cable looped in Token Ring Hub, defective couplers, poor grade of cable, defective patch cables, improper pair twists, and split pairs.

Resistance is measured by measuring a loop through each pair in the cable. For example, the value reported in ohms for pins 1, 2 is the resistance from pin 1 in the cable looped to pin 2. During testing, resistance is said to fail if measured resistance values on pairs used by the Network Type selected is greater than the resistance for a maximum length loop (100 meters for most networks).

Noise is an effect on a signal from outside sources. A Scanner may measure the electrical noise on a cable to verify that noise levels do not interfere with LAN performance. Unshielded twisted-pair (UTP) is particularly sensitive to noise in its environment. Noise is measured in three frequency bands to help isolate possible sources:

| Noise Band | Frequency Range | Possible Source |
|---|---|---|
| Low | 10 ~ > 150 Khz | Fluorescent lights, |
| Mid | 150 Khz ~ > 16 Mhz | Motors, video, etc. |
| High | 16 Mhz ~ > 100 Mhz | Radio, TV |

The effects of excessive capacitance on a Level 5 transmission circuit are disastrous. Excessive capacitance will create a delay in the transmission of the digital signal, a catastrophic effect in light of the narrow time gap between digital pulses which are transmitted at a rate of 100 million bits per second. As a result, excess capacitance will bring a Level 5 circuit "down."

It is well known in the art that an electrical circuit based on direct current voltage is adversely affected by the addition of a capacitor in that the capacitor creates a time delay in the current traveling around the circuit. In the context of the present invention, digital signal transmission is based on direct current voltage provided by either the local telephone company ("telco") or a computer. Predictably, digital transmission of Level 5 signals is distorted by excess capacitance in the circuit. Computer transmission of digital signals is accomplished over a telecommunications network which utilizes the telephone "pair" system. Because these pairs are long, i.e., stretch in parallel for long distances, each pair behaves like a capacitor. To minimize the effects of capacitance in wires and a cable, telecommunications cable is currently manufactured so that the wires comprising each pair are carefully and individually twisted in a way which decreases the effects of said capacitance.

However, excess capacitance is also created by a telephone pair of wires which are in "multiple" with the desired transmission path. The term "multiple" is known to those skilled in the art as the term which identifies when the "count" of the transmission element or wire is the same, thus indicating more than one possible transmission path. For example, when a feeder pair, A, is joined to two distribution pairs, B and C, pair B is in multiple with pair C. Thus, when a telephone or other telecommunications device is placed on the end of pair C, pair B creates capacitance on the circuit. Pair B is known in the art as "bridge tap."

Bridge tap may be avoided by having a skilled technician place a separate line from the telco distribution/demarcation block to each user individual telecommunications device, such as a computer or telephone. However, administrative records must be constantly maintained in the event a person changes office locations. Further, reconfiguration of the network is expensive and time consuming.

In the '277 patent, extraordinarily fast reconfigurations of an office telephone network is achieved because, for example, pair one which is assigned to the first work station picks off the feeder cable from the Telco distribution punch down block. However, while pair one serves as a transmission path for the first work station, pair one also appears in other work stations to the field side of the initial connection between the first work station's Xtractor assembly and the feeder cable. The portion of pair one extends to the distribution side is therefore not used for direct transmission of a signal from the user telecommunications device and a bridge-tap is formed. This bridge-tap may cause Level 5 LAN environments to fail. Based on this inventor's experience, six feet of bridge-tap or more will cause transmission failure of signals at these greater speeds. As a result, the wiring system disclosed in the '277 patent is unsuitable for Level 5 or higher transmission rates. Therefore, there is a need in the art to provide a wiring device and wiring system which may be physically placed by an unskilled technician and yet will support these higher rates of transmission.

Near End Cross Talk also causes Level 5 transmission circuits to fail. The inventor has determined that a db level of approximately 18 will cause such a failure. As the 18 db cutoff is approached, performance of the Level 5 system declines. It has been discovered that certain connectors having db levels of approximately 40 will perform well at Level 5, but multiple connectors attached in series cause decreased performance at Level 5. Prior art diversion leads terminated on prior art connectors are typically terminated at staggered pin positions. Therefore, a db level approaching 50 db or more is highly desirable in that multiple connectors could be attached in series while maintaining high quality performance at Level 5.

The present invention provides a telecommunications wiring device which overcomes the shortcomings of the known telecommunications wiring systems by providing a telecommunications device capable of normal analog voice transmission as well as reliable data transmissions without a bridge-tap and with a high NEXT db measurement, while being also capable of being placed physically by an unskilled technician.

SUMMARY OF THE INVENTION

It is in the view of the above problems that the present invention was developed. The invention is a telecommunications wiring device having a feeder side and a distribution side. At the feeder side a first connector is disposed on the feeder side of a cable segment having a plurality of wires, wherein at least two of said wires located at the feeder side of said cable segment are pre-selectively terminated in the first connector while the remaining pairs continue to pass on to the next work station. An extraction lead having a plurality of wires is also connected to said first connector, wherein a wire of the extraction lead is pre-selectively terminated in the first connector in a location conventionally reserved for the pre-selectively unterminated wires of the cable segment. As a result, the pre-selectively unterminated wires of the cable segment prevent unwanted bridge-tap.

Further features and advantages of the present invention, as well as the structure and operation of various embodiments of the present invention, are described below in detail with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings:

FIG. 6 illustrates a preferred wiring schematic table indicating in greater detail the wiring schematics of FIGS. 3–5.

DETAILED DESCRIPTION OF THE PREFERRED EMBODIMENTS

Figure 1:
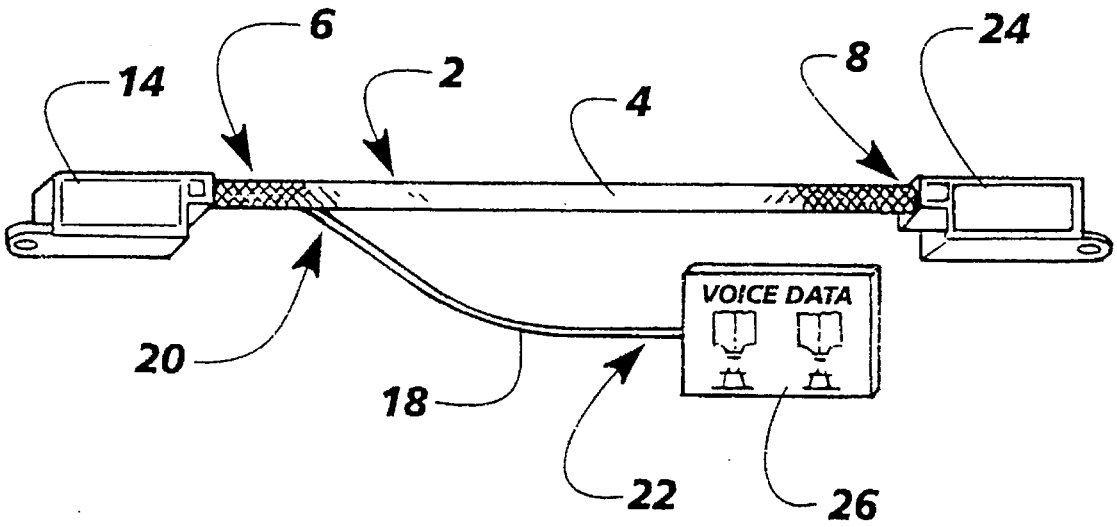
FIG. 1 illustrates the telecommunications wiring device of the present invention.
Figure 2:
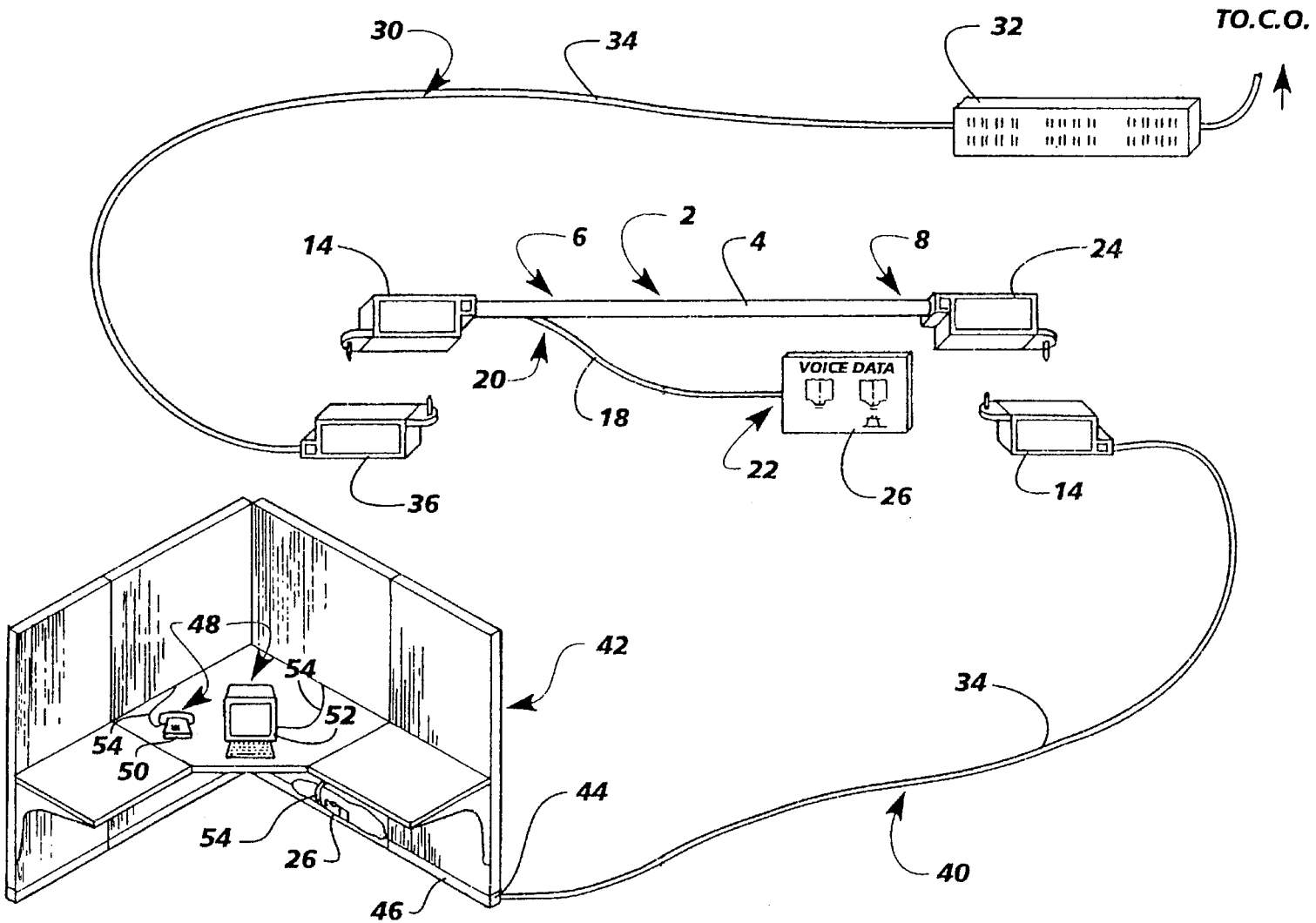
FIG. 2 illustrates the telecommunications wiring system utilizing the telecommunications wiring device of the present invention.

Referring to the accompanying drawings in which like reference numbers indicate like elements, FIGS. 1 and 2 show the telecommunications wiring device generally at 2. Telecommunications wiring device 2 is comprised of a first cable segment 4 having a first end 6 and a second end 8. Preferably, first end 6 is designated as the feeder side while second end 8 is designated as the distribution side. First cable segment 4 may be obtained from sources well known in the industry such as AT&T, as well as General Cable. The pairs within first cable segment 4 are factory-twisted by the cable manufacturer. Because this invention is preferably used within a building environment, first cable segment 4 may have a polymeric flame-retardant sheath. It is also possible that first cable segment 4 may utilize a shielded cable sheath in order to prevent induced voltage from causing noise interference with the cable pairs. A first connector 14 is disposed on said first end 6 of said first cable segment 4. First connector 14 is also disposed on first end 20 of second cable segment or diversion lead 18. As shown in FIGS. 1 and 2, first connector 14 and second connector 24 are similar except that they are opposite in gender. Preferably, first connector 14 is male, while the second connector 24 is female. First and second connectors, 14 and 24, must be suitable for terminating 22, 24 or 26 gauge wire, preferably a 50 pin Telco connector. The only limitation on first and second connectors, 14 and 24, would be that first connector 14 be removably attachable to a mating connector and that second connector 24 also be removably attachable to a mating connector. It is preferred that either first connector 14 or second connector 24 be equipped with a capacitive film circuitry such as that manufactured by the Amphenol Corporation to reduce NEXT. In the preferred embodiment, connectors sold under the trademark AMPHENOL sold by the Amphenol Corporation meet the foregoing connector requirements.

At first end 6 of first cable segment 4, only preselected wire pairs are terminated in the first connector 14. The remaining unterminated wires are cut short and do not enter the housing of the first connector 14 to prevent inadvertent contact or interference. At second end 8 of the first cable segment 4 all wire pairs are terminated in second connector 24, as distinguished from the wire pairs at first end 6 of first cable segment 24 wherein only preselected wire pairs are terminated. However, the method of terminating the pairs in either connector remain the same, namely, that approximately ½ of an inch of the length of the wires are untwisted in order to provide enough physical length to allow reliable termination of the wires. This inventor has found that untwisting the wires for lengths greater than ½ of an inch degrades performance at higher transmission rates. It should be noted that the lower rates of transmission would more easily accommodate a longer length of untwisted wire for termination purposes.

Diversion lead 18 has a first end 20 and a second end 22. Preferably, diversion lead 18 is a four-pair "Inside Wire" ("IW"). IW is a type of wiring commonly used inside buildings having a flame-retardant sheath and being commercially available in sizes of four-pair, six-pair, eight-pair, and sixteen-pair. Certain of the pairs, preferably all four pairs, of diversion lead 18 are pre-selectively terminated in first connector 14. An elastic wrap, or heat shrink, not shown, may be placed around first connector 14, first end 6 of the first cable segment 4, and first end 20 of diversion lead 18. Such an elastic wrap heat shrink will prevent relative movement between first cable segment 4 and diversion lead 18 and enhance the reliability of termination in first connector 14 by reducing the possibility that individual wires are pulled or disconnected therefrom. One type of preferred elastic wrap may be made from rubber.

Cable segment 4 can be no longer in length than 100 meters, as IEEE standard 802.5 which governs Level 5 transmission rates requires that the office distribution network on the field side of the telco demarcation punch down block be limited to 100 meters in length.

User telecommunications interface 26 terminates wires of second end 22 of diversion lead 18. Interface 26 is preferably of a type known in the art as an "RJ45" type but could alternatively be of an RJ12 type or RJ11 type.

FIGS. 3–6 illustrates preferred wiring schematics for six work stations, utilizing first cable segment 4, preferably a twenty-five pair cable, a first connector 14 having a twenty-five pair termination capacity, a diversion lead 18, preferably utilizing a four-pair IW, and two RJ45 user telecommunications interfaces 26. As can be seen from the wiring schematics, wires for transmitting and receiving electrical signals are separated and prevent signal crossover and signal crosstalk. As shown in FIGS. 3–6, all pins of the male connector that are not wired to an RJ45 are connected straight through to the same pin number of the female connector.

Figure 3:
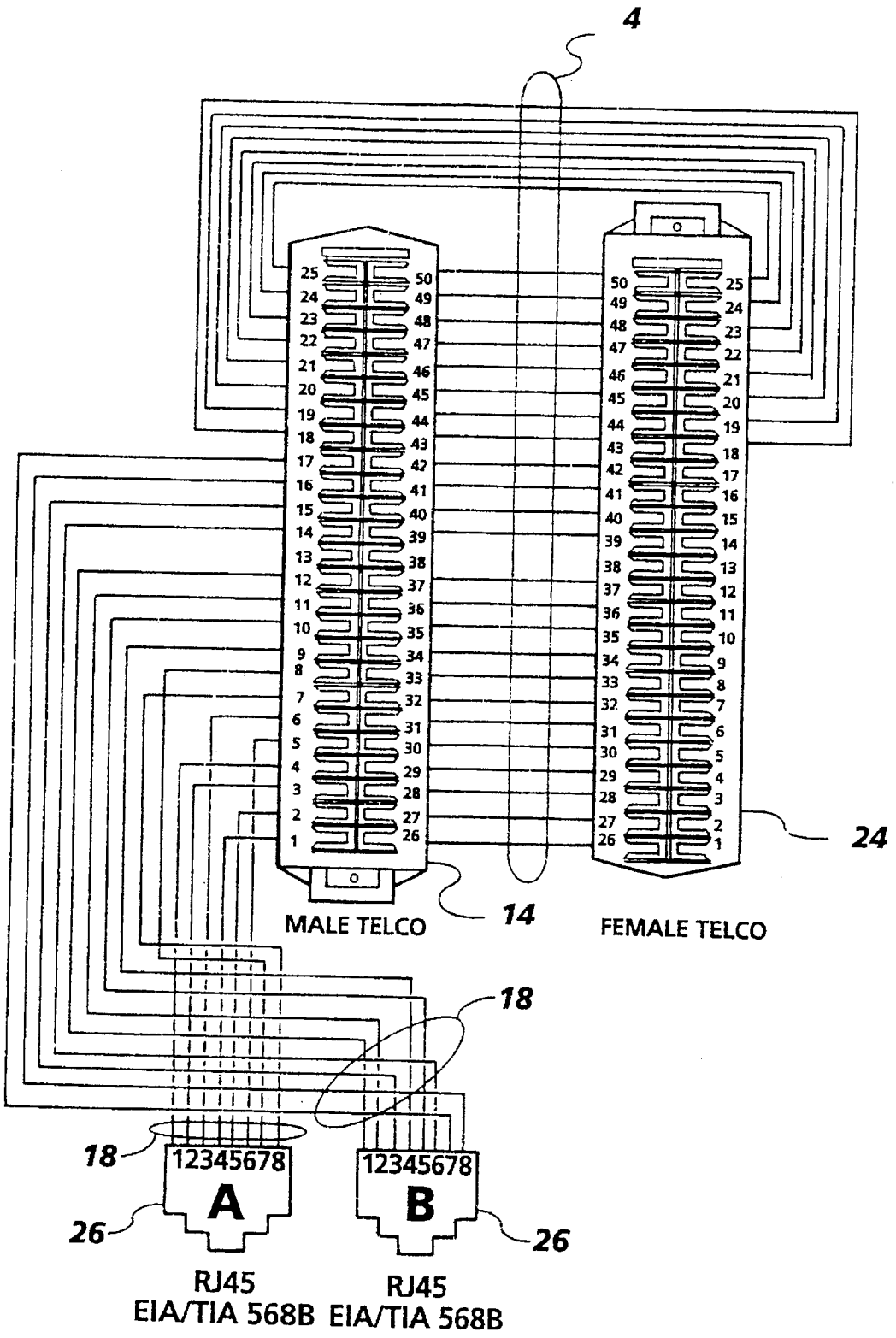
FIG. 3 illustrates a preferred wiring schematic of a first connector and a second connector for a first and a second work station.
Figure 4:
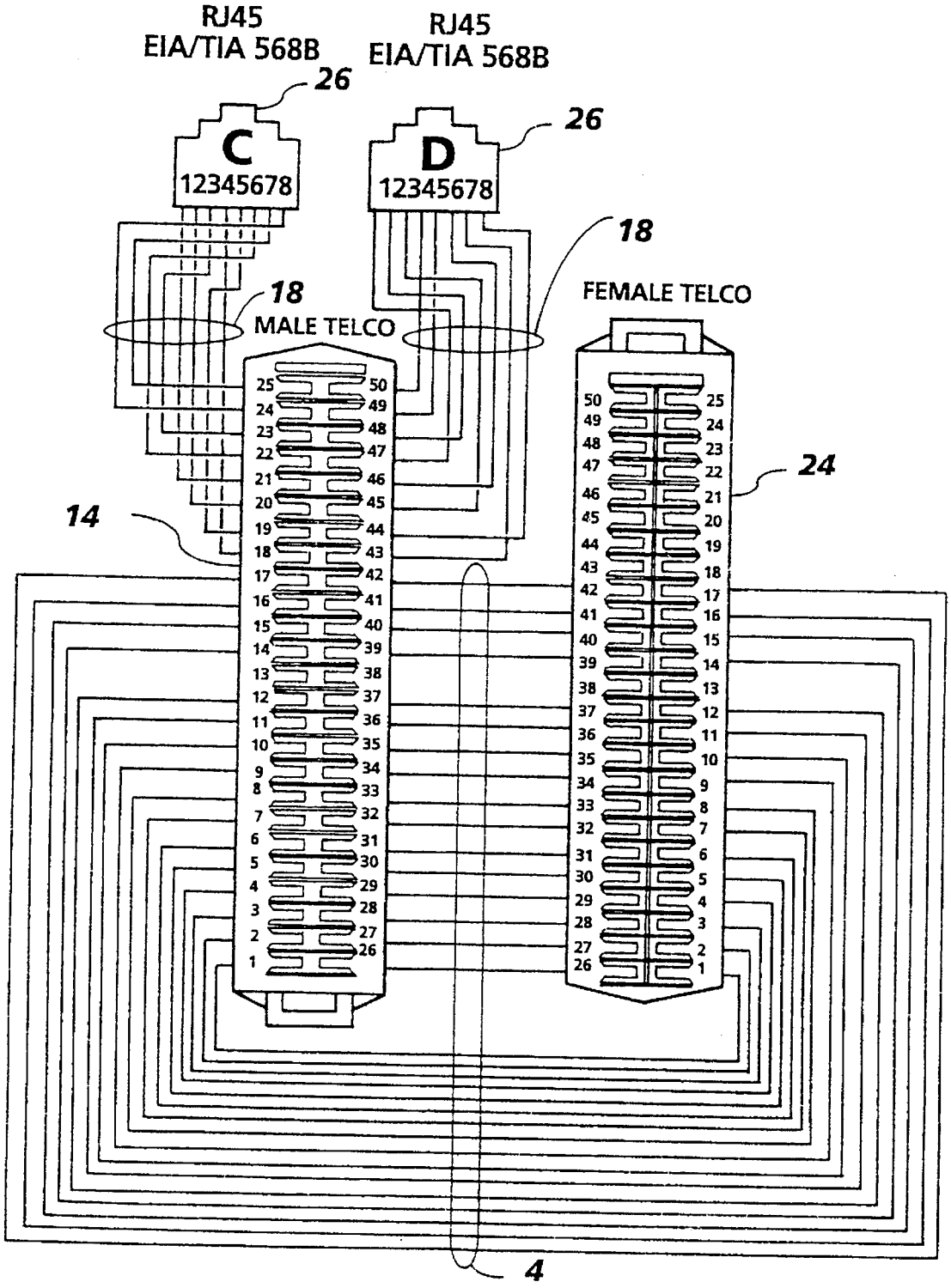
FIG. 4 illustrates a preferred wiring schematic of a third and a fourth connector for a third and a fourth work station.
Figure 5:
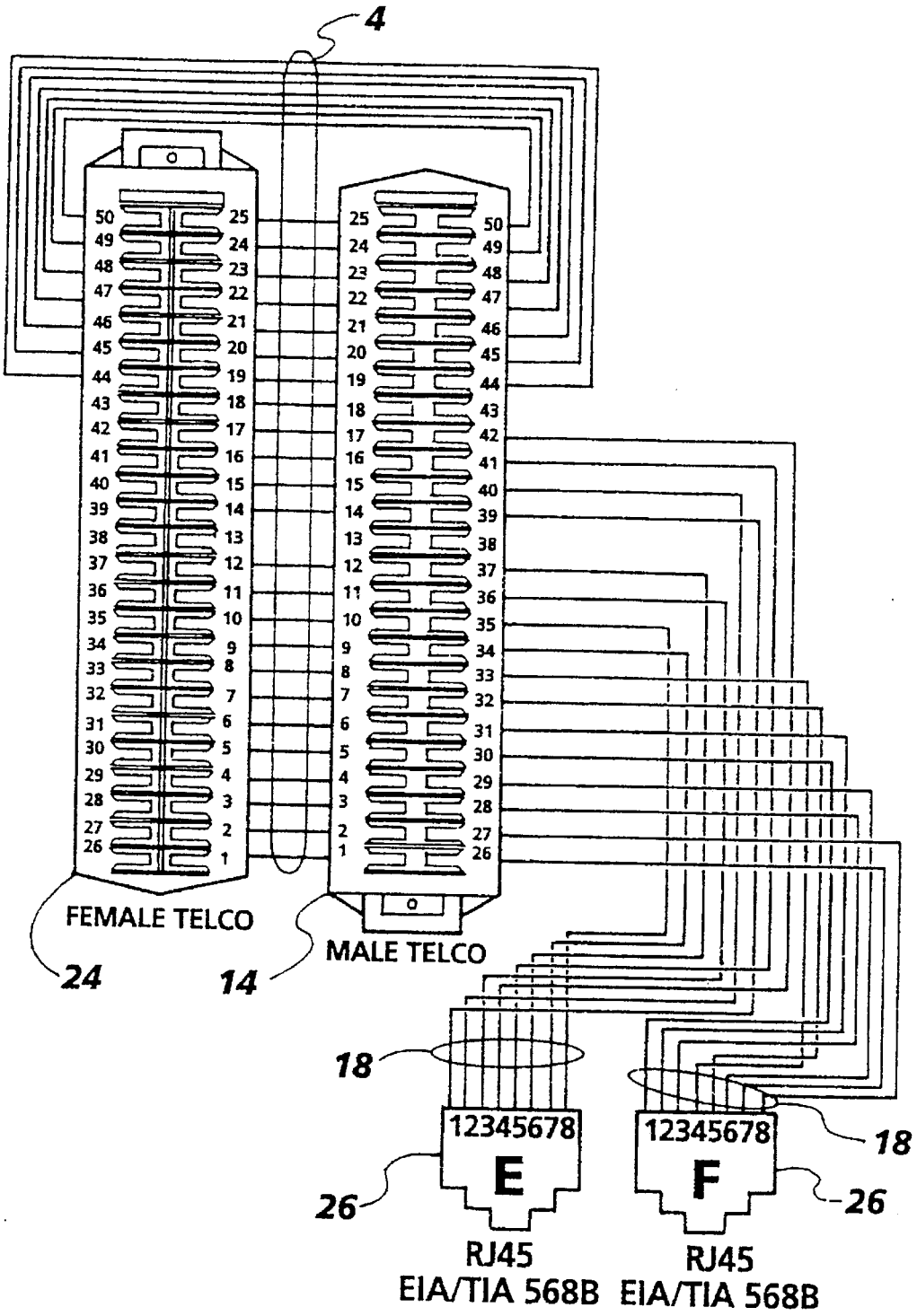
FIG. 5 illustrates a preferred wiring schematic of a fifth and a sixth connector for a fifth and a sixth work station.

It should be noted that connector 24 is shown to have nine unterminated pairs in FIG. 3, even though all twenty-five pairs of first cable segment may be in fact terminated at second connector 24, as first end 6 of first cable segment 4 may have nine unterminated pairs in first connector 14 corresponding to the eight terminated pairs of user telecommunications interfaces 26, A and B, respectively. The termination of all pairs of first cable segment 4 in second connector 24 is consistent with the schematics shown in FIGS. 3–6 as FIGS. 3–6 are primarily directed to nodal connections between first connector 14, user telecommunications interface 26, and second connector 24.

Conventional wisdom taught by the prior art held that NEXT is controlled and reduced by separating the wires of each pair into opposite pin location terminations. For example, an RJ45 would terminate one pair at pin connectors 1 and 26, the subsequent pair at pin terminations 2 and 27, and the next pair at pin terminations 3 and 28, etc. Due to an extensive trial and error process spanning approximately seven years, it has been discovered that a major factor affecting NEXT levels is the extent to which the wires for each cable pair are untwisted prior to termination. Specifically, NEXT levels are substantially reduced in Level 5 transmission whenever each terminated cable pair is untwisted ½ inch or less prior to termination within connector, 14 or 24.

Accordingly, another aspect of the present invention includes the steps of identifying twisted wires in a cable which are capable of termination on said pin terminations of said telecommunications wire connector, identifying twisted wires in a cable which are capable of said termination without untwisting more than ½ inch in length, and preselecting said pin terminations which are compatible with both of the foregoing identification steps. The wiring schematic of FIGS. 3–6 provide a means to achieve the ½ inch limitation after applying the foregoing method. The resulting pin terminations are exactly opposite those taught by the prior art. For example, under the preferred embodiment of the present invention, the first pair entering RJ45, marked "A" in FIG. 3, is terminated at pin positions 1 and 2, as opposed to pin positions 1 and 26 taught by the prior art. The ½ inch limitation is satisfied by keeping the wires composing pair 1 together as long as possible prior to termination. Based on the preferred connector and the preferred wiring schematics depicted in FIGS. 3–6, NEXT db levels over 59 db have been achieved. Given these NEXT db measurements, multiple connectors, 14 and 24, may be combined in series without declining performance at Level 5.

Based on the wiring schematics of FIGS. 3–5 and FIG. 6 in particular, it can be seen that the wiring scheme adopted allows a minimum length of each cable pair to be untwisted prior to termination.

FIG. 6 specifies in the outer columns the preselected cable pairs and each pair's preselected pin termination. For greater clarity, the color of each wire is provided adjacent the preassigned pin termination for each. In addition, the tip and ring of each pair is also identified. As a result, multiple wiring devices 2 may be connected serially, male connector 14 to female connector 24, to provide preselected signal paths to multiple work stations. For flexibility, it is recognized that telecommunications user interface 26 which is illustrated as an RJ45 capable of terminating four pairs may also employ other terminating interfaces of varying capacity; for example, an eight pair terminating interface would employ a wiring schematic of the RJ45s designated at A and B in FIGS. 3 and 6. The importance of the present invention should not be limited to the type or capacity of telecommunications user interface 26 used so long as the pair and pin selections identified in the wiring schematics of FIGS. 3–6 are employed.

In use, signal transmission from a central office feeder side to user telecommunications devices 48, will now be explained. Distribution block, patch panel or Telco distribution interface 32 represent the demarcation point between local telephone company facility ownership and the owner of the office distribution network. Cabling 34 is fully pre-terminated in Telco distribution interface 32. It is noted that because the preferred embodiment uses a 25-pair cable, multiple 25-pair cables may be pre-terminated in Telco distribution interface 32 in keeping with a STAR Local Area Network (LAND topology. Cabling 34 is then fully terminated in a connector 36 which is of the same gender type as second connector 24.

During signal transmission, a signal path from the central office is created through Telco distribution interface 32, cabling 34, connector 36 and therefore to attached first connector 14. At this point, the preselected signal paths either continue along first cable segment 4 for those wire pairs in the first cable segment 4 which are pre-selectively terminated in first connector 14; for those connector locations in first connector 14 which are pre-selectively occupied by the wires of diversion lead 18, a signal path extends from feeder device 30 through first connector 14 and consequently through diversion lead 18 and ending at user telecommunications interface 26 for connection to analog signal compatible devices such as telephones or digital signal compatible devices such as computers. It should be noted that diversion lead 18 is preferably of a length suitable for placing within a chase or an office partition or wall. If multiple telecommunications wiring devices 2 are connected serially, each should be pre-selectively terminated at each connector, 14 and 24, according to the wiring schematics shown in FIGS. 3–6.

Second connector 24 is removably attached to a first connector 14 of loop closing device 38. Because of the connection between second connector 24 and first connector 14 of loop closing device 38, the signal paths which are not diverted by diversion lead 18 continue along first cable segment 4 continue through second connector 24 and first connector 14 of loop closing device 38, and continue through cabling 40 of loop closing device 38. Cabling 40 enters office partition paneling 42 through entry opening 44 and extends through low chase 46. A convenient location, preferably coextensive with a knockout portion of office partition paneling 42, cabling 40 is terminated by user telecommunications interface 26. Inside wire 54 extends from user telecommunications devices, shown generally at 48, namely, a telephone 50 and computer 52. Inside wire 54 extends from computer 52 to user telecommunications interface 26, thereby completing a preselected signal path from punch down block 32 to user telecommunication device 48 such as computer 52. Inside wire 54 extends from telephone 50 to user telecommunications interface 26, thereby completing a proselected signal path from punch down block 32 to telephone 50. It should be noted that the use of the telecommunications wiring devices 2 of the present invention result in end-to-end signal transmission between punch down block 32 and user telecommunications devices 48 without any bridge tap or excess capacitance. Thus, it is shown that the telecommunications wiring device 2 of the present invention is instrumental in eliminating bridge tap while attaining the advantages desired. In view of the foregoing, it will be seen that the several objects of the invention are achieved and other advantages are attained. The embodiments were chosen and described in order to best explain the principles of the invention and its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. For example, in the preferred embodiment, first connector 14 is male while second connector 24 is female in gender; however, it is contemplated to fall within the scope of the present invention that these genders may be easily reversed. Another modification falling within the scope of the present invention involves multiple telecommunications wiring devices connected in series which utilize cable larger than twenty-five pairs. By simply applying the principles of wire separation embodied in FIGS. 3–6 and appropriately sized connectors, larger cable sizes may be accommodated. A further modification contemplated by the present invention involves use of more or less than two user telecommunications interfaces 26, as 3 or more jacks may be employed. Thus, the breadth and scope of the present invention should not be limited by any of the above-described exemplary embodiments, but should be defined only in accordance with the following claims appended hereto and their equivalents.

What is claimed is:

1. A telecommunications cabling assembly comprising:

a first cable segment having first and second ends, said first cable segment having a plurality of wires;

a first connector of a first gender type disposed on said first end of said first cable segment, wherein at least two of said wires located at said first end of said first cable segment are terminated according to a predetermined wiring plan in said first connector and the remaining complementary wires remain unterminated in said first connector;

a second connector of an opposite gender type disposed on said second end of said first cable segment, wherein said terminated wires of said first connector are terminated in said second connector at said second end of said first cable segment;

a second cable segment having first and second ends, said second cable segment having a plurality of wires, wherein a wire of said second cable segment is terminated according to the predetermined wiring plan in said first connector in a location conventionally reserved for said unterminated wires of said first cable segment;

whereby a single preselected signal path is provided for connection to a user telecommunications device enabling transmission of electrical signals at a rate of 100 Mbs through said telecommunications cabling assembly.

2. A telecommunications cabling assembly according to claim 1, wherein said first and second gender types are respectively male and female.

3. A telecommunications cabling assembly according to claim 1, further comprising:

a third cable segment which is preterminated in a distribution block at one end and having a third connector of a second gender type on the other end, wherein said third connector is removably attachable to said first connector of said first gender type.

4. A telecommunications cabling assembly according to claim 3, further comprising:

a plurality of office divider panels in an office area; and means for interconnecting one end of said telecommunications cabling assembly with said distribution block for communication with the office area, wherein said second cable segment is disposed substantially within said office divider panels, and wherein said terminated wires of said second cable segment provide a single signal path to a user telecommunications device devoid of bridge tap from said distribution block to the office area.

5. A telecommunications cabling assembly according to claim 1, wherein a user telecommunications device interface is disposed on a second end of said second cable segment for connection to a user telecommunications device.

6. A telecommunications cabling assembly according to claim 5, wherein said user telecommunications device interface is of an RJ11-type.

7. A telecommunications cabling assembly according to claim 5, wherein said user telecommunications device interface is of an RJ12-type.

8. A telecommunications cabling assembly according to claim 5, wherein said user telecommunications device interface is of an RJ45-type.

9. A telecommunications cabling assembly according to claim 5, wherein said user telecommunications device is a telephone.

10. A telecommunications cabling assembly according to claim 5, wherein said user telecommunications device is a computer.

11. A method of providing telecommunications local system connections between a distribution block and each of a plurality of user telecommunications devices, comprising:

assigning a single signal path for each of a plurality of user telecommunications devices from a plurality of available transmission paths from the distribution block to each user telecommunications device;

providing at least one cabling device including a connector of first gender type adapted for being connected to the distribution block and connector of a second gender type at the other end adapted for being interconnected with a diversion cabling device;

providing at least one diversion cabling device comprising first and second cable segments, wherein said first cable segment is partially terminated at its first ends in a terminating connector of a first gender type and said second cable segment is terminated according to a predetermined wiring plan in said terminating connector at locations which are not occupied by the termination of said first cable segment of said first gender type;

terminating said first cable segment at its second end in a connector of a second gender type for connection to a second diversion cabling device;

terminating said second cable segment at its second end in a telecommunications device interface, wherein a said assigned signal path from said local termination facility to each of said user telecommunications devices is devoid of bridge tap and electrical signals may be transmitted through said signal path at a rate of 100 Mbs.

12. A method of providing telecommunications local system connections between a distribution block and each of a plurality of user telecommunications devices according to claim 11, wherein said first and second gender types are respectively male and female.

13. A method of providing telecommunications local system connections between a distribution block and each of a plurality of user telecommunications devices according to claim 11, further comprising:

terminating a third cable segment at one end in a local termination facility;

providing a third connector at the other end of said third cable segment, wherein said third connector is removably attachable to said first connector of said first gender type.

14. A method of selecting pin terminations on a telecommunications wire connector for operating at a Level 5 transmission rate comprising the steps of:

assigning pin termination locations to pairs of twisted wires in a non-flat cable such that said pairs are capable of termination without untwisting more than ½ inch in length.

15. A method according to claim 14 wherein one of said identified pairs of twisted wires is assigned to terminate on pin terminations 1 and 2.

16. A method according to claim 14 wherein one of said identified pairs of twisted wires is assigned to terminate on pin terminations 3 and 4.

17. A method according to claim 14 wherein one of said identified pairs of twisted wires is assigned to terminate on pin terminations 5 and 6.

18. A method according to claim 14 wherein one of said identified pairs of twisted wires is assigned to terminate on pin terminations 7 and 8.

19. A method according to claim 14 wherein one of said identified pairs of twisted wires is assigned to terminate on pin terminations 9 and 10.

20. A method according to claim 14 wherein one of said identified pairs of twisted wires is assigned to terminate on pin terminations 11 and 12.

* * * * *